US005944547A

United States Patent [19]

Golab et al.

[11] Patent Number: 5,944,547

[45] Date of Patent: Aug. 31, 1999

[54] CONNECTOR SHORTING BAR RETENTION

[75] Inventors: Randolph S. Golab, Warren, Pa.; Matthew J. Hoff, Jamestown, N.Y.; Timothy J. Miller, Warren, Pa.

[73] Assignee: Osram Sylvania Inc., Danvers, Mass.

[21] Appl. No.: 09/046,659

[22] Filed: Mar. 24, 1998

[51] Int. Cl.[6] ..... H01R 29/00

[52] U.S. Cl. ..... 439/188; 200/51.1

[58] Field of Search ..... 439/188, 746, 439/747; 200/51.1, 51.09

[56] References Cited

U.S. PATENT DOCUMENTS

| | | | |
|---|---|---|---|
| 2,636,067 | 4/1953 | Kraft | 439/746 |
| 5,263,872 | 11/1993 | Marpoe et al. | 439/188 |
| 5,647,754 | 7/1997 | Kohno | 439/188 |
| 5,788,520 | 8/1998 | Roche | 439/188 |

*Primary Examiner*—Neil Abrams
*Assistant Examiner*—T C Patel
*Attorney, Agent, or Firm*—William H. McNeill

[57] ABSTRACT

A connector is provided which includes first and second insulative housings each of which includes first and second contacts, respectively, which may be electrically and mechanically connected and disconnected, in a connected mode and disconnected mode, respectively. The first insulative housing includes shorting bars which are spring biased into contact with the first contacts in the disconnected mode. The second insulative housing includes engagement posts which engage the shorting bars in a connected mode to disengage the shorting bars from the first contacts. An improved manner of mounting the shorting bars in the first insulative housing from the rear of such housing is provided. Each shorting bar is firmly held in place by the mating of a housing keeper within the first insulative housing and shorting bar latches.

12 Claims, 6 Drawing Sheets

CONNECTOR SHORTING BAR RETENTION

TECHNICAL FIELD

The present invention relates to a connector which includes a female connector housing having female contacts and a mating male connector housing having male contacts which may be electrically and mechanically connected together. Shorting bars are provided in one of the connector housings and mating engagement posts are provided in the other connector housing. The present invention particularly relates to the manner in which such shorting bars are mounted in the connector housing.

BACKGROUND ART

In fabricating electrical connectors, shorting bars are typically mounted in a respective connector housing from the front of the connector. The front of the connector is the engagement end; that is, the end at which contacts housed in one connector housing are inserted into mating contacts housed in another connector housing. Embodiments assembled by front end loading typically include sealing means which are held in place by a cover and a spacer which also serve to retain the shorting bars in place. Therefore, in embodiments where shorting bars are inserted in the engagement end of a first connector, sealing means and a multiplicity of retention means are required including a cover and spacer. In addition, front end loading reduces the amount of terminal stop during use of the device. In other words, in embodiments where shorting bars are inserted in the engagement end of a first connector housing, during use there is a tendency for such shorting bars to be pushed out of position when the second connector housing is mated with the first. Such movement of shorting bars is undesirable. For example, such movement alters the position of the shorting bars vis-a-vis the contacts which the shorting bars must engage, when the connector housings are disconnected, thereby adversely affecting the shorting function.

DISCLOSURE OF THE INVENTION

It is an object of the present invention to provide an improved connector.

It is another object of the present invention to provide a connector housing wherein shorting bars mounted therein are firmly held in place during the mating of a female connector housing with a male connector housing.

It is a further object of the present invention to provide a connector housing having shorting bars mounted therein without multiple retention means for holding the shorting bars in place.

Yet a further object of the present invention is to provide an improved connector housing wherein shorting bars are inserted therein from the rear of the housing.

Another object of the present invention is to provide shorting bars in a connector housing such that the connector housing does not require sealing or a cover and spacer to hold the shorting bars in place.

A further object of the present invention is to provide an improved shorting bar.

A further object of the present invention is to provide a shorting bar which achieves all of the foregoing objectives.

This invention achieves these and other objects by providing a connector which comprises first and second slidably engaging housings which comprise mating contacts. The first housing comprises at least one aperture therein, and at least one keeper extending into the aperture from a surface of the housing. The keeper extends in the direction of a longitudinal axis of the first housing from a first end to an opposite second end. The first housing comprises at least one shorting bar member. Each shorting bar member comprises a flexible conductive shorting bar positioned within the first housing. At least one mating engagement post extends from the second housing. Each engagement post is constructed and arranged for engaging at least one shorting bar and separating at least one shorting bar from contact with a mating contact. Each shorting bar comprises at least one latch which engages a keeper.

BRIEF DESCRIPTION OF THE DRAWINGS

This invention may be clearly understood by reference to the attached drawings wherein like elements are designated by like reference numerals and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
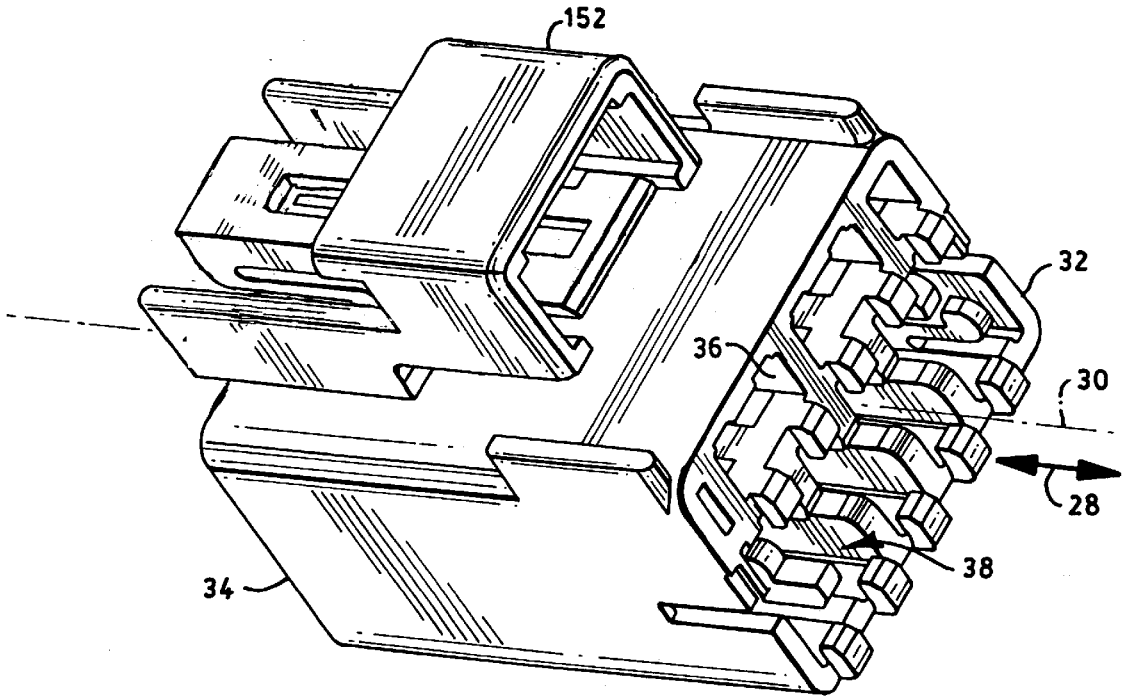
FIG. 1 is a front perspective view embodying one form of a first housing of the present invention.
Figure 2:
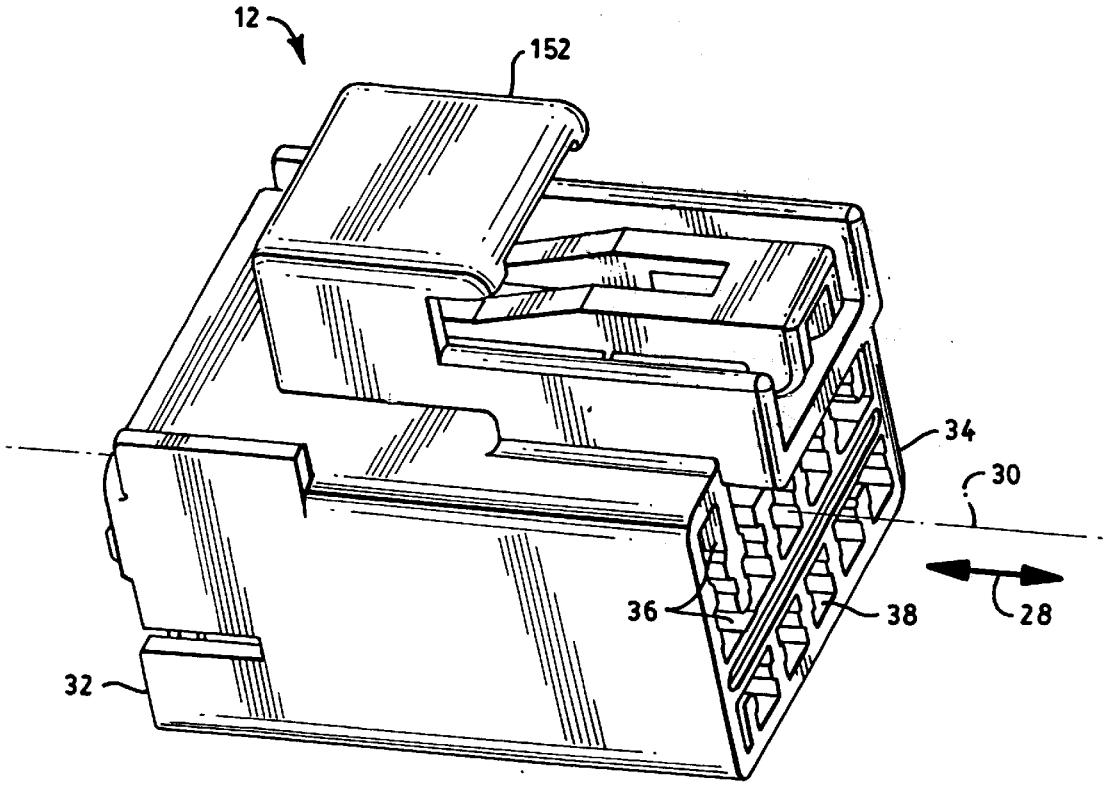
FIG. 2 is a rear perspective view of the first housing of FIG. 1.
Figure 3:
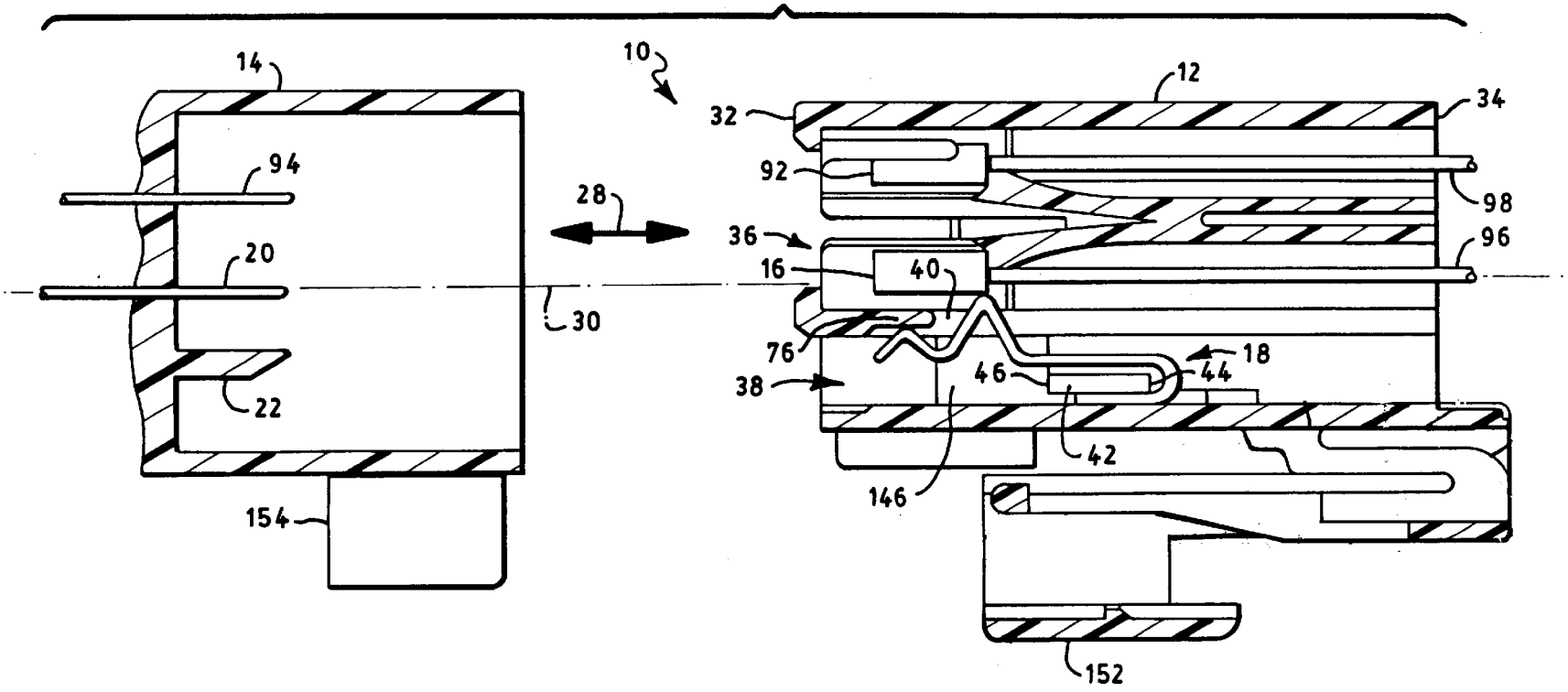
FIG. 3 is a cross section of a first housing and a second housing embodying one form of the present invention.
Figure 4A:
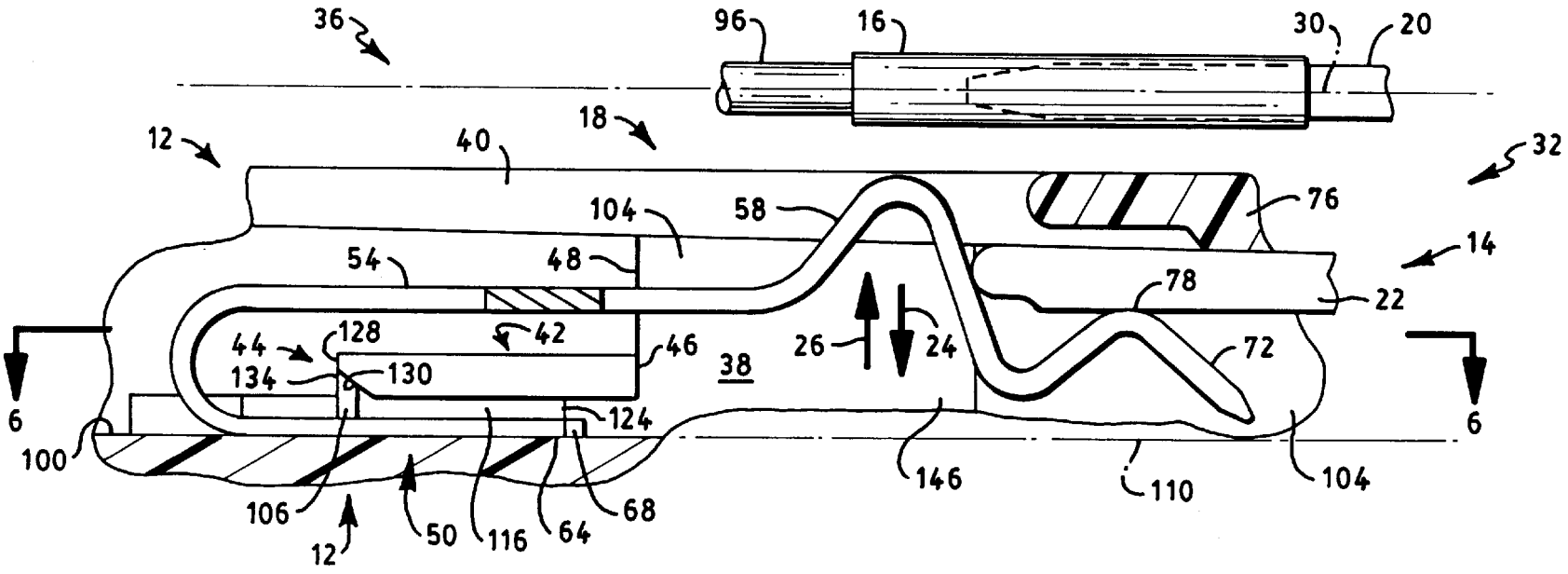
FIG. 4A is a cross sectional partial diagrammatic representation of the shorting bar of FIG. 5 assembled within the first housing of FIGS. 1 to 3 when the housing is in a connected mode.
Figure 4B:
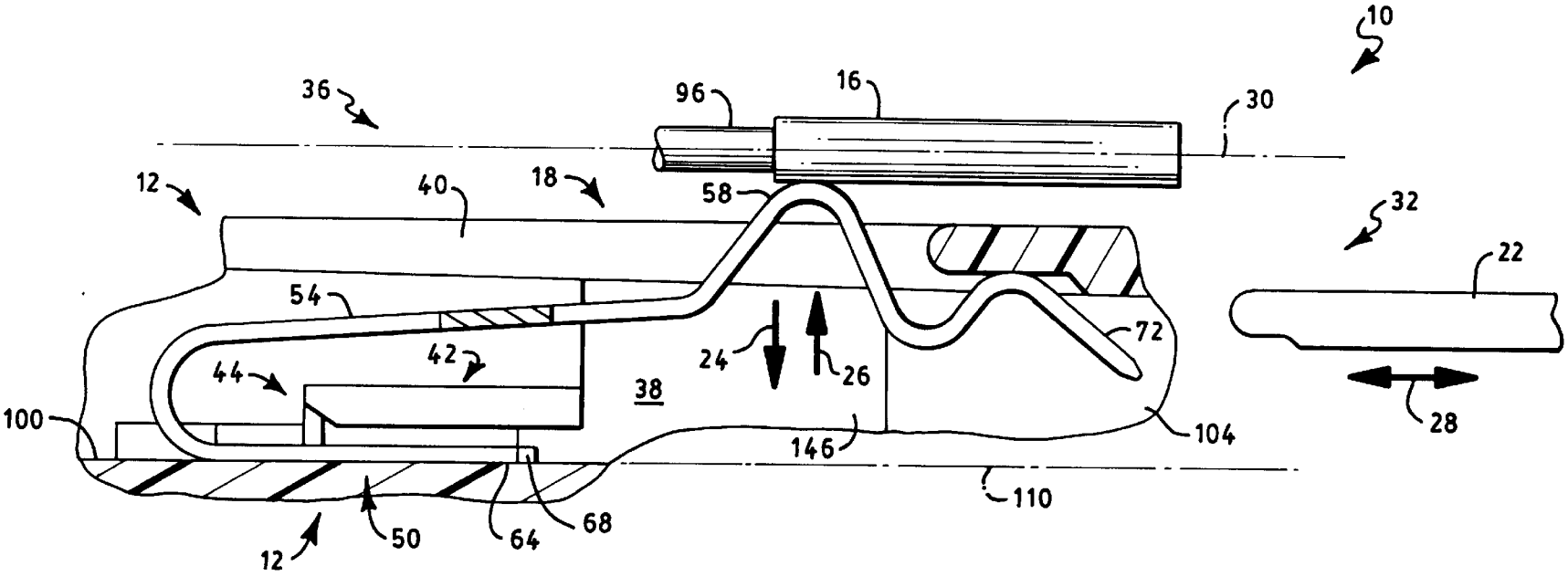
FIG. 4B is a cross sectional partial diagrammatic representation of the shorting bar of FIG. 5 assembled within the first housing of FIGS. 1 to 3 when the housing is in a disconnected mode.

The embodiment of this invention which is illustrated in the drawings is particularly suited for achieving the objects of this invention. FIGS. 3 and 4 illustrate a connector 10 comprising a first insulative housing 12 and a second insulative housing 14. First housing 12 comprises a row of first contacts 16 and a row of flexible shorting bars 18 engageable and disengageable relative to respective first contacts 16 as described herein. By way of example, in the embodiment illustrated, the first contacts 16 are female contacts. The second insulative housing 14 comprises a row of second contacts 20 and a row of engagement posts 22. By way of example, in the embodiment illustrated, the second contacts 20 are male contacts. The second insulative housing 14 is adapted for connection with the first insulative housing 12. In particular, the first insulative housing 12 may be mated with the second insulative housing 14 in a connected mode by inserting the male contacts 20 into respective female contacts 16 to effect a mechanical and electrical connection therebetween. With reference to FIG. 4A, during such insertion, the engagement posts 22 are inserted into the first insulative housing 12 and engage the ends of respective shorting bars 18 to disengage the shorting bars from the contacts 16 by camming each shorting bar in the direction of arrow 24 away from a respective contact 16. Such movement of the shorting bar 18 eliminates the shorting caused by the previous engagement of the protruding contact surface of the shorting bar 18 with the female contact 16. The connector 10 is now electrically and mechanically connected and fully operational. The first insulative housing 12 may be separated from the second insulative housing 14, in a disconnected mode, by withdrawing the male contacts 20 from respective female contacts 16. With reference to FIG. 4B, during such withdrawal, the engagement posts 22 are withdrawn from the first insulative housing 12 and thereby disengage the ends of respective shorting bars 18 permitting each shorting bar to flex in the direction of arrow 26 into engagement with a respective contact 16 to short the connector in the usual manner.

The first insulative housing 12 extends in the direction 28 of a longitudinal axis 30 from a front 32 of the housing 12 to a rear 34 as illustrated in FIGS. 1 to 4. First insulative housing 12 comprises a plurality of first apertures 36 which extend through the housing 12 in the direction 28, and a plurality of second apertures 38 which extend through housing 12 in the direction 28. Apertures 36 are parallel to apertures 38. Each aperture 36 is connected to an aperture 38 by an opening 40 which extends between apertures 36 and 38. A contact 16 extends in each aperture 36 from the front 32 towards the rear 34. Each aperture 38 includes at least one keeper extending therein from a housing surface. For example, in the embodiment illustrated in FIGS. 3 and 4, each aperture 38 includes at least one keeper 42 extending from a housing surface into aperture 38. Each keeper extends in direction 28 from a first keeper end 44 to an opposite second keeper end 46.

Figure 5:
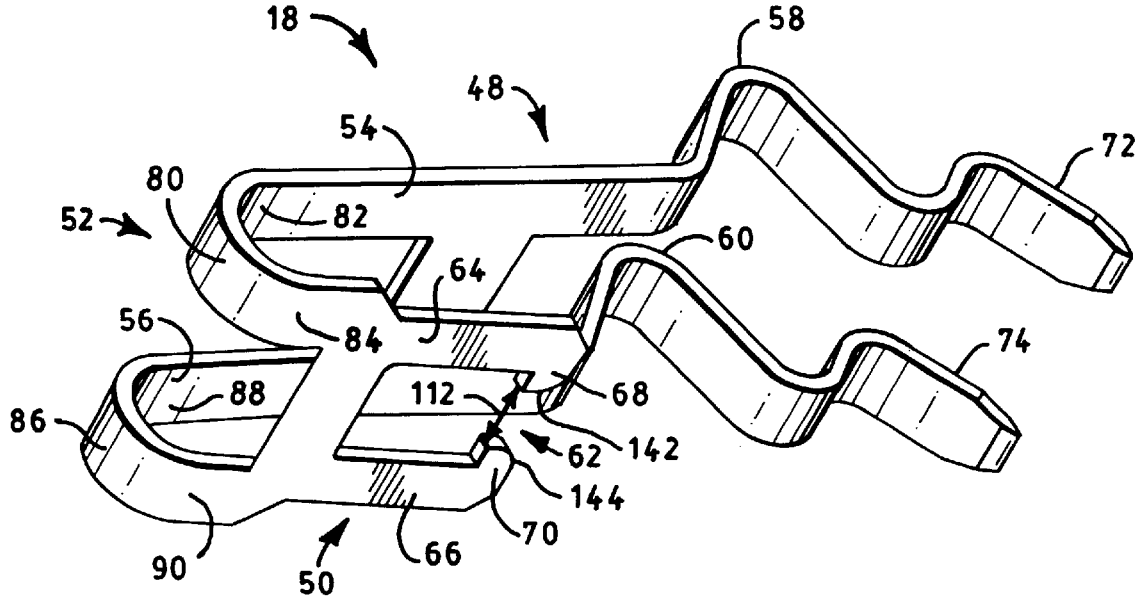
FIG. 5 is a perspective view of a shorting bar embodying one form of the present invention.

A detailed configuration of a preferred shorting bar 18 is depicted in FIG. 5. Shorting bar 18 comprises an upper length 48 and a lower length 50 joined together by a connecting length 52, the upper length being flexible relative to the lower length. The upper length of the shorting bar of the present invention comprises at least one surface contacting a respective contact. In the embodiment of FIG. 5, the shorting bar 18 comprises two protruding contact surfaces. In particular, the upper length 48 comprises a first leg 54 and a second leg 56 each of which extends from the connecting length 52. Leg 54 includes a first protruding contact surface 58, and leg 56 includes a second protruding contact surface 60. In the preferred embodiment, the lower length of the shorting bar of the present invention also includes at least one latch which engages a keeper 42 to hold the shorting bar in place as described herein. In the embodiment of FIG. 5, the shorting bar 18 comprises two opposing latches which are spaced at 62 and extend towards each other to grasp a keeper as described hereinafter. In particular, the lower length 50 comprises a first arm 64 and a second arm 66 each of which extends from the connecting length 52. Arm 64 includes a first latch 68 which is spaced from and extends towards a second latch 70 of arm 66. The upper length of the shorting bar of the present invention comprises at least one surface for engagement with a respective engagement post. In the embodiment of FIG. 5, the shorting bar 18 comprises two engagement surfaces. In particular, leg 54 comprises a first engagement surface 72 at a distal end of leg 54, and leg 56 comprises a second engagement surface 74 at a distal end of leg 56.

Each shorting bar 18 extends into a respective second aperture 38 in such a manner that the upper length 48 and lower length 50 extend from the connecting length 52 towards the front 32 of the insulative connector 12 as illustrated in FIGS. 3 and 4. The latches 68,70 of the arms 64,66 are spring-like and snap into place against the keeper 42 to facilitate holding the shorting bar in place relative to the insulative housing 12 as described in detail hereinafter. The protruding contact surfaces 58 and 60 extend through an opening 40 into a first aperture 36 for engagement with a respective contact 16, and the engagement surfaces 72 and 74 extend towards the front 32 of the insulative housing 12. The housing 12 includes a plurality of retaining lengths 76 which extend in the direction 28 of the longitudinal axis 30 towards the rear 34 of the housing and are formed as a part thereof as illustrated in FIG. 3. Each retaining length 76 is aligned with a respective aperture 38 and extends into such aperture 38 such that when assembled, a retaining length engages a shorting bar 18 adjacent an engagement surface 72 or 74. For example, in the embodiment of FIGS. 3 and 4B, a retaining length 76 extends into a second aperture 38 and engages the shorting bar 18 at surface 78 which is adjacent an engagement surface 72.

In the preferred embodiment, the shorting bar 18 is configured as depicted in FIG. 5. In particular, shorting bar 18 comprises a radiused connecting first segment 80 extending from end 82 to end 84 and a radiused connecting second segment 86 extending from a similar end 88 to end 90. In such embodiment, when installed in the insulative housing 12, the leg 54, leg 56, arm 64 and arm 66 will each extend towards the front 32 of the insulative housing. Arms 64 and 66 have distal ends which include the spaced latches 68 and 70, respectively, which extend towards each other. The arms 64 and 66, and the latches 68 and 70 are constructed and arranged to mate with the keeper 42, of the housing 12, as described hereinafter.

In the embodiment of FIGS. 1 to 4, the first insulative housing 12 may comprise a row of third contacts such as female contacts 92, and the second insulative housing 14 may comprise a row of fourth contacts such as male contacts 94. Contacts 92 and 94 are connected or disconnected in the connected mode or disconnected mode, respectively, in the same manner described herein regarding the contacts 16 and 20. Conductors 96 and 98 extend into the housing 12, and are electrically and mechanically connected to a respective contact 16 and 92 in a conventional manner as, for example, by soldering or welding.

Figure 6:
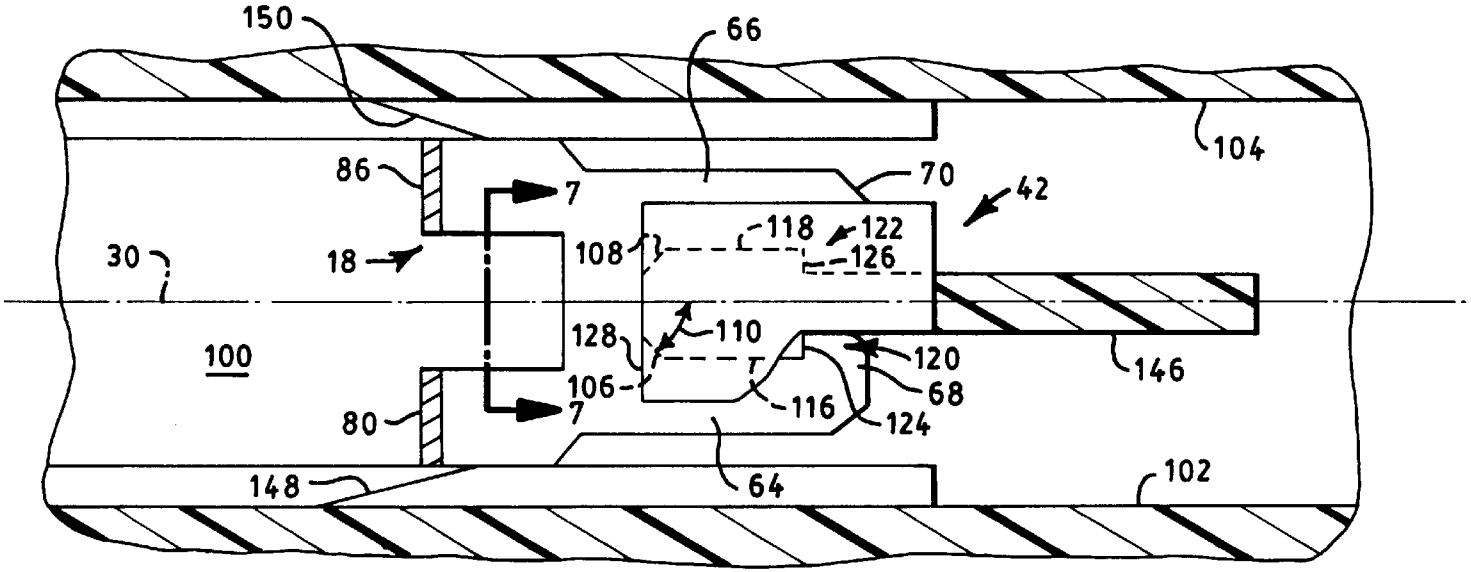
FIG. 6 is a partial cross section, partially broken away, of FIG. 4A taken along lines 6—6.
Figure 7:
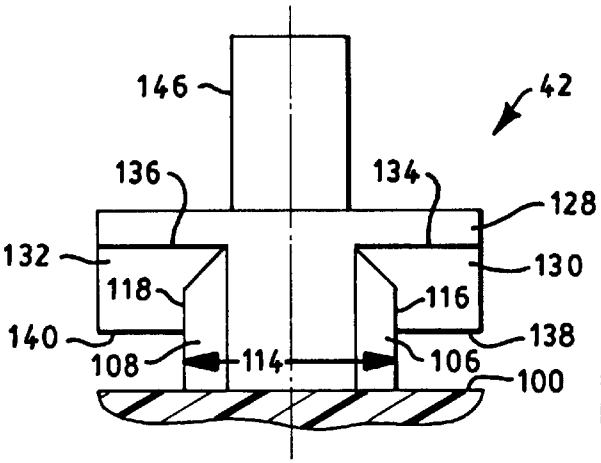
FIG. 7 is a partial cross section, partially broken away, of FIG. 6 taken along lines 7—7 with the shorting bar 18 removed.

In the preferred embodiment, the keeper 42 is constructed and arranged as illustrated in FIGS. 4, 6 and 7. Keeper 42 extends into aperture 38 from a surface 100 which is a base surface of the aperture 38. In particular, aperture 38 is formed by the base surface 100 and opposing side surfaces 102 and 104 which project from base surface 100. As is illustrated in FIG. 6, the keeper 42 is centered between the opposing side surfaces 102 and 104. The end 44 of the keeper 42 extends towards the rear 34 of housing 12 and includes opposite camming surfaces 106 and 108 which extend at an angle 110 relative to the longitudinal axis 30. Camming surfaces 106 and 108 are provided to cam the latches 68 and 70 away from each other as the shorting bar 18 is inserted into the rear 34 of housing 12. In particular, the distance 112 (FIG. 5) which defines the space 62 between the distal end of the latches 68 and 70 is less than the width 114 (FIG. 7) between the outer keeper surfaces 116 and 118 of the keeper 42. Such relative dimensions in combination with the angularity of the camming surfaces 106 and 108 and the resiliency of arms 64 and 66 causes the latches 68 and 70 to be cammed apart as the shorting bar 18 is inserted into the rear 34 of the housing 12. In particular, the latches 68 and 70 engage the camming surfaces 106 and 108, respectively, and slide along such surfaces as the shorting bar 18 is moved towards the front 32 of housing 12, causing the arms 64 and 66 to be urged apart. Continued insertion of the shorting bar 18 causes the latches 68 and 70 to slide along respective outer keeper surfaces 116 and 118 until the latches are adjacent respective recesses 120 and 122 of the keeper 42. When the latches 68, 70 are adjacent respective recesses 120 and 122, the latches spring towards each other and engage the keeper 42 at respective keeper retaining surfaces 124 and 126 as best illustrated in FIG. 6. Such interlocking of the latches 68 and 70 of the shorting bars 18 with the surfaces 124 and 126 of the keeper 42 serves to retain the shorting bar 18 in place relative to the housing 12.

In the embodiment illustrated in FIGS. 4, 6 and 7, the keeper 42 includes a rear portion 128 which faces the rear 34 of housing 12. The rear portion 128 is substantially perpendicular to the axis 30. Rear surfaces 130 and 132 extend at an angle towards axis 30. Surfaces 130 and 132 provide guiding surfaces which facilitate the insertion of the shorting bar 18 into housing 12. Surfaces 130 and 132 extend from rear edges 134 and 136 of rear portion 128 to respective undersides 138 and 140 of the keeper 42. The camming of the latches 68 and 70 may be facilitated by providing the shorting bar 18 with respective first curved portion 142 and second curved portion 144 (FIG. 5) which engage, respectfully, the camming surfaces 106 and 108 of the keeper 42.

A central wall 146 adjacent end 46 of the keeper 42 serves to guide the legs 54 and 56 into the housing 12 and provides an insulative wall between such legs. Bevelled rails 148 and 150 may be provided extending from surfaces 102 and 104, respectively, to facilitate guiding the shorting bar 18 into the end 34 of the housing 12 as best illustrated in FIG. 6.

When connecting the housings 12 and 14 by inserting the male contacts 20, 94 into respective female contacts 16, 92, and camming the shorting bars 18 by inserting the engagement posts 22 of housing 14 into housing 12, it will be noted that the shorting bar 18 will not be pushed out of the second aperture 38, or otherwise moved, towards the rear 34 of the insulative housing 12 as the male contacts are inserted into the female contacts and the engagement posts engages the engagement surfaces 72 and 74 to cam surfaces 58 and 60 downward. In particular, the shorting bars 18 will be retained in place by the engagement of the latches 68 and 70 with the surfaces 124 and 126 of keeper 42.

Fabrication of the various components described herein may be accomplished using conventional procedures. For example, the insulative housings, may each be molded from a plastic material, such as, without limitation, nylon or polypropylene. The contacts and the shorting bars, may be stamped from a metal sheet and then rolled and/or bent as required to form the desired configuration. The insulative housings 12 and 14 may be of the type described in U.S. Pat. No. 5,370,550. In particular housings 12 and 14 may have a lock disabler as described in such patent. The two lock portions of such a lock disabler are depicted diagrammatically in the drawings at 152 and 154.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A connector comprising: first and second slidably engaging housings which comprise mating contacts, said first housing comprising at least one aperture therein which extends from a rear of said first housing towards a front of said first housing, at least one keeper extending into said aperture from a surface of said first housing, said first housing surface being a base surface of said aperture, said aperture being formed by said base surface and opposing side surfaces which project from said base surface, and further wherein said keeper is positioned between said opposing aperture side surfaces, said keeper extending in the direction of a longitudinal axis of said first housing from a first end to an opposite second end; said first housing comprising at least one shorting bar member positioned in said aperture, each shorting bar member comprising a flexible conductive shorting bar structured and arranged for contacting a contact of said first housing; at least one engagement post extending from said second housing, said at least one engagement post structured and arranged for engaging said shorting bar and separating said shorting bar from said contact of said first housing; each shorting bar comprising at least one latch which engages said keeper for retaining said shorting bar in place in relation to said first housings, said shorting bar further comprising a first length joined to a second length by a connecting length, said first length comprising a first leg and a second leg each of which extends in said direction from said connecting length towards said front, said second length comprising a first arm and a second arm each of which extends in said direction from said connecting length towards said front, said first and second arms comprising respective opposing first and second distal latches, said first distal latch extending towards said second distal latch, and said second distal latch extending towards said first distal latch, said first and second opposing distal latches engaging said keeper.

2. The connector of claim 1 wherein said first end of said keeper faces said rear and includes a first camming surface and a second camming surface each of which extend at an angle relative to said longitudinal axis, said first and second distal latches being structured and arranged (a) to be cammed apart by said first and second camming surfaces, respectively, at said first end, and (b) to spring together and engage said keeper at respective first and second retaining keeper surfaces.

3. The connector of claim 2 wherein said keeper comprises a rear portion which faces said rear of said housing, said rear portion being substantially perpendicular to said longitudinal axis and comprising a rear surface which extends at an angle towards said longitudinal axis.

4. The connector of claim 1 wherein said keeper comprises at least one retaining keeper surface between said first end and said second end, said at least one latch engaging said at least one retaining keeper surface.

5. The connector of claim 1 comprising a first retaining keeper surface adjacent a first side of said keeper and a second retaining keeper surface adjacent an opposite second side of said keeper, said first distal latch engaging said first retaining keeper surface and said second distal latch engaging said second retaining keeper surface.

6. The connector of claim 3 wherein said rear surface extends from a rear edge of said keeper to a first underside and a second underside of said keeper, said first underside extending adjacent a first side of said keeper and said second underside extending adjacent an opposite second side of said keeper.

7. The connector of claim 6 wherein said first arm is positioned between said first underside and said base surface, and wherein said second arm is positioned between said second underside and said base surface.

8. The connector of claim 1 further comprising a housing wall which is adjacent said second end of said keeper and which extends in said direction towards said front of said housing, said housing wall being perpendicular to said base surface and being substantially centered in relation to said keeper.

9. The connector of claim 1 further comprising a housing wall which is adjacent said second end of said keeper and which extends in said direction towards said front of said housing, said housing wall being perpendicular to said base surface and being substantially centered in relation to said keeper, said housing wall extending between said first leg and second leg.

10. The connector of claim 9 wherein said first end of said keeper faces said rear and includes a first camming surface and a second camming surface each of which extend at an angle relative to said longitudinal axis, said first and second distal latches being structured and arranged (a) to be cammed apart by said first and second camming surfaces, respectively, at said first end, and (b) to spring together at, and engage, said keeper at respective first and second keeper retaining surfaces.

11. The connector of claim 1 wherein said first distal latch includes a first curved portion and wherein said second distal latch includes a second curved portion.

12. A connector, comprising:

a first insulative housing comprising a plurality of first contacts and a plurality of flexible conductive shorting bars, said plurality of shorting bars being engageable and disengageable relative to said plurality of first contacts, and a second insulative housing comprising a plurality of second contacts and a plurality of engagement posts, said second insulative housing adapted for connection to said first insulative housing in a connected mode and disconnection from said first insulative housing in a disconnected mode, said plurality of first contacts being electrically and mechanically connected to and disconnected from said plurality of second contacts, in said connected mode and disconnected mode, respectively, and said plurality of engagement posts engaging said plurality of shorting bars to disengage said plurality of shorting bars from said plurality of first contacts, in said connected mode, and said plurality of first contacts being disconnected from said plurality of second contacts, and said plurality of engagement posts being disengaged from said plurality of shorting bars to permit said plurality of shorting bars to flex into engagement with said plurality of first contacts, in said disconnected mode, said first insulative housing extending in the direction of a longitudinal axis from a front to a rear and comprising a plurality of first apertures extending into said first insulative housing in said direction, and a plurality of second apertures extending into said first insulative housing in said direction, from said rear towards said front, said plurality of first apertures being parallel with said plurality of second apertures, each first aperture of said plurality of first apertures being connected by a respective opening to a second aperture of said plurality of second apertures, each first aperture comprising at least one first contact of said plurality of first contacts, each second aperture comprising at least one keeper and at least one shorting bar of said plurality of shorting bars, said at least one keeper extending in said direction, said at least one shorting bar comprising an upper length and a lower length joined together by a connecting length, said upper length having at least one protruding contact surface and at least one engagement surface, and being flexible relative to said lower length, said lower length having at least one latch, said at least one shorting bar extending into a respective second aperture such that (a) said at least one latch engages a keeper, (b) said at least one protruding contact surface is extendable through an opening into a first aperture, and (c) said at least one engagement surface extends towards said front, and further, wherein said lower length of said shorting bar comprises a first arm and a second arm each of which extends from said connecting length towards said front, said first arm comprising a first distal latch and said second arm comprising a second distal latch, said first distal latch extending towards said second distal latch, and said second distal latch extending towards said first distal latch, said first and second distal latches engaging a respective retaining keeper surface of said keeper.

* * * * *